United States Patent [19]

Kehler

[11] Patent Number: 4,919,443

[45] Date of Patent: Apr. 24, 1990

[54] SWING-OUT BACKPACK FOR WHEELCHAIRS

[75] Inventor: Garry Kehler, Calgary, Canada

[73] Assignee: 378134 Alberta Ltd., Calgary, Canada

[21] Appl. No.: 219,484

[22] Filed: Jul. 15, 1988

[51] Int. Cl.[5] ..... A47C 7/62

[52] U.S. Cl. ..... 280/304.1; 248/145; 297/191

[58] Field of Search ..... 248/145; 297/163, 188, 297/191; 280/289 WC, 289 A, 289 H, 304.1

[56] References Cited

U.S. PATENT DOCUMENTS

| | | | |
|---|---|---|---|
| 1,238,320 | 8/1917 | Moon | 248/145 |
| 1,508,052 | 9/1924 | Hastings | 248/145 |
| 2,067,983 | 1/1937 | Rice | 248/145 |
| 3,709,556 | 1/1973 | Allard et al. | 297/188 |
| 4,372,605 | 2/1983 | Cervantes | 297/188 X |
| 4,431,206 | 2/1984 | Pryor | 280/289 WC |
| 4,580,803 | 4/1986 | Davis | 280/289 WC |

FOREIGN PATENT DOCUMENTS

| | | |
|---|---|---|
| 864875 | 3/1971 | Canada . |
| 957661 | 11/1974 | Canada . |
| 1156948 | 11/1983 | Canada . |

*Primary Examiner*—Charles A. Marmor
*Assistant Examiner*—Michael Mar
*Attorney, Agent, or Firm*—Sixbey, Friedman, Leedom & Ferguson

[57] ABSTRACT

A swing-out backpack for wheelchair use is provided. The backpack comprises a container box with sides, a back, a front, a top, and a bottom. The box has a pivotal door therein to provide access to an interior chamber within the box. A structure releasably secures the container box to the side frame and back post assembly of the wheelchair. It includes a post to be secured in vertical orientation to the wheelchair at one side of the back thereof. The container box is pivotally mounted to the post to swing between a first position adjacent an armrest of the wheelchair and a second position behind the wheelchair. According to the present invention, the device may be readily adapted to most types of wheelchairs, and provides a removable, easily useable container box for use by a person in a wheelchair for supporting or storing objects.

13 Claims, 3 Drawing Sheets

SWING-OUT BACKPACK FOR WHEELCHAIRS

FIELD OF THE INVENTION

The present invention relates to a swing-out backpack for wheelchairs, and more particularly to a container and frame assembly which may be releasably mounted to a wheelchair for use by a person in the wheelchair or by an attendant for that person.

BACKGROUND OF THE INVENTION

There currently does not exist any convenient backpack structure, to be mechanically associated with a wheelchair, adapted particularly for handicapped people confined to wheelchairs. The majority of physically disabled persons confined to wheelchairs presently utilize a conventional fabric-type pack which is hung in or over the side rail of the backpack and/or the back post or chair support frame of the wheelchair. Because such handicapped persons must remain seated in their wheelchairs, their mobility and reach is much more restricted than those of normal persons. Accordingly, it is difficult, or at times impossible, for such an individual to personally place articles in (or remove articles from) a conventional fabric-type pack located at the back of his or her wheelchair. The side frame and back post assembly of the wheelchair are often higher than such a person's mobility may allow that person to reach. Furthermore, it is extremely difficult for most physically disabled persons to have visual access to articles in a conventional fabric pack which is hung behind the back of the wheelchair. Disabled persons confined to a wheelchair, therefore, must struggle to remove the fabric pack if they can, or more often, seek assistance from another person who can freely access the pack for that person. This limits that person's independence and results in a lack of convenient accessibility to such a backpack.

An additional disadvantage of such fabric-type packs may arise when the pack interferes with the rear wheels on the wheelchair, thereby affecting the motion and manoeuvreability of the wheelchair.

References of general background interest, with respect to the present invention, include U.S. Pat. No. 4,431,206 Pryor issued Feb. 14, 1984 which describes and illustrates a wheelchair-mounted accessory carrier for carrying oxygen bottles, intraveneous containers and other medical accessories, Canadian patent No. 1,156,948 of Trubiano issued Nov. 15, 1983 which describes and illustrates a container basket of the shopping cart-type which is adapted to be transported by a wheelchair and which is removably securable to the armrests of the wheelchair, and Canadian patent No. 864,875 of Pivacek issued Mar. 2, 1971 which describes and illustrates a locking connection for removable footrests, legrests and other attachments for wheelchairs. Also of interest is Canadian patent No. 957,661 of Sibley issued Nov. 12, 1974 which describes and illustrates a foldable jack and/or baggage carrier for a snowmobile.

OBJECT OF THE INVENTION

It is an object of the present invention to provide a backpack for wheelchairs, which backpack is more accessible and which is simpler and easier to operate for persons with limited strength, arm extension and the like, in a wheelchair. It is a further object of the present invention to provide such a backpack which may be easily and releasably mounted on most wheelchairs, and which is compact, multi-purpose, convenient and attractive.

SUMMARY OF THE INVENTION

In accordance with the present invention there is provided a swing-out backpack for wheelchair use. The backpack comprises a container box with sides, a back, a front, a top, and a bottom. The box has a pivotal door therein to provide access to an interior chamber within the box. A structure releasably secures the container box to the side frame and back post assembly of the wheelchair. The structure includes a post to be secured in vertical orientation to the wheelchair frame at one side of the back thereof. The container box is pivotally mounted to the post to swing between a first position adjacent an armrest of the wheelchair and a second position behind the wheelchair back.

In a preferred embodiment of the backpack according to the present invention, a lock means releasably secures the container box in the second position. As well, the top is flat and positioned and oriented, so when the box is in its first position, it provides a surface for writing or for supporting objects, for the wheelchair user.

The mechanical backpack according to the present invention is detachably securable to the side frame and back post assembly of the wheelchair and may be used by a person in the wheelchair to contain personal articles. It is adaptable to most wheelchairs, simply by securing the structure means to the side frame and back post assembly of the wheelchair. It provides convenient access to the container to permit easy placement or removal of articles within the range of easy visibility for a person seated in the wheelchair. It is much easier to access when adjacent to either armrest of the wheelchair than the fabric-type packs conventionally in use.

BRIEF DESCRIPTION OF THE DRAWINGS

These and other objects and advantages of the invention will become apparent upon reading the following detailed description and upon referring to the drawings in which.

Figure 1:
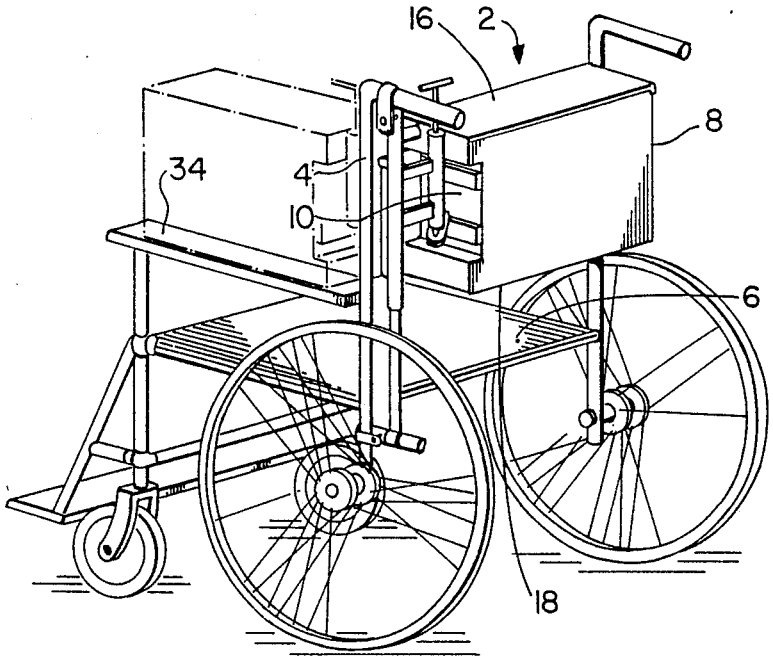
FIG. 1 is a perspective view of a backpack for wheelchairs in accordance with the present invention, mounted on a wheelchair.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE DRAWINGS

In the drawings, similar features have been given similar reference numerals.

Turning to the drawings there is shown, in FIG. 1, a swing-out backpack 2, in accordance with the present invention, mounted on the side frame and back post assembly 4 of a conventional wheelchair 6. Backpack 2 comprises a container box 8 having sides 10, top 16 and bottom 18. Top 16 is preferably pivoted to the rest of container box 8 so as to provide access to the interior chamber within the box. Hinged top 16 is preferably provided with a rubber or other non-slip cover, on its upper surface, to enhance its usefulness as a work or support surface.

Outwardly extending from one corner of box 8 are a pair of vertically spaced flanges 20 having aligned apertures therein.

To secure container box 8 to the side frame and back post assembly 4 of wheelchair 6, a telescopic post 24, having clamp means 26 and 28 at its ends, is provided. Upper clamp 26 is releasably securable, as illustrated, to upper handle 29 of one of the side frames and back post assemblies 4, and lower clamps 28 is releasably securable to clamp tube 30 which in turn is releasably clamped to a lower portion of side frame and back post assembly 4, as illustrated, to extend rearwardly, horizontally therefrom. In this manner, post 24 is releasably secured to the wheelchair, in vertical orientation.

Rearwardly extending from post 24 and secured in vertically aligned, spaced fashion as illustrated are a pair of upwardly extending hinge pins 32. When flanges 20 are positioned with hinge pins 32 through their aligned apertures, container box 8 is then pivotally mounted on post 24, but can be readily removed therefrom by simply lifting flanges 20, so that the apertures 22 clear pins 32.

The position of hinge pins 32, vertically, may be of course predetermined so as to provide maximum ease of handling for a wheelchair user.

Figure 2:
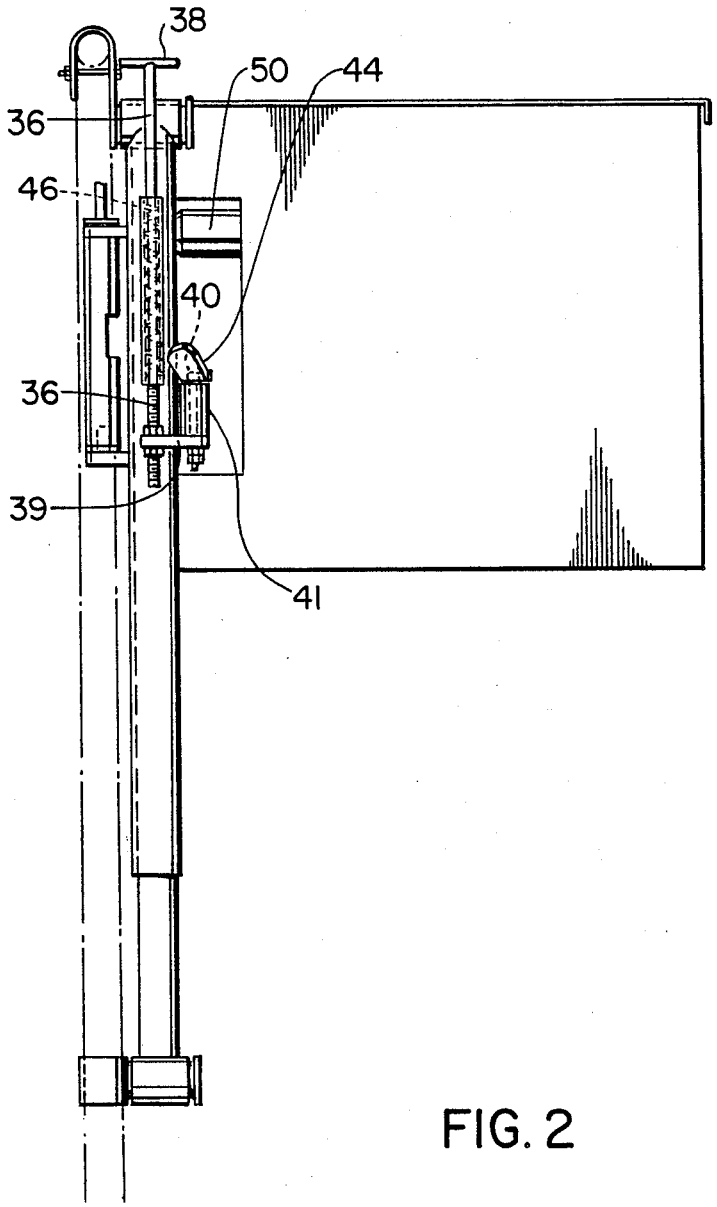
FIGS. 2 and 3 are respectively elevation views from the back and side of the backpack of FIG. 1.
Figure 3:
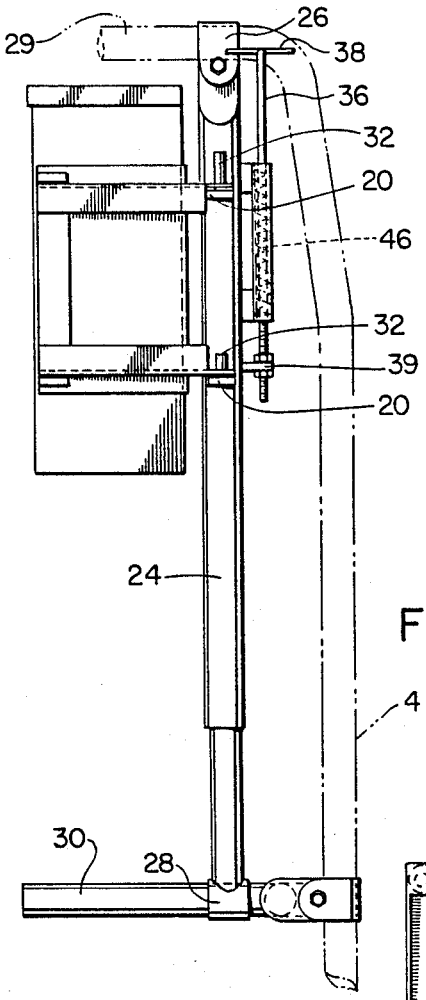
Figure 4:
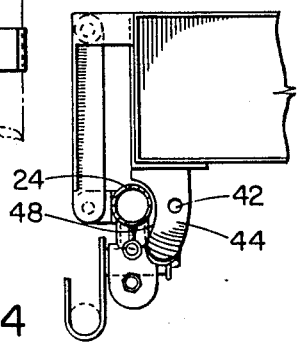
FIG. 4 is a partial plan view from the top of the backpack of FIG. 1.

To control the pivoting movement of container box 8 when mounted for pivoting on hinge pins 32 of post 24 so that box 8 swings between a first position adjacent an armrest 34 of wheelchair 6 (phantom, FIG. 1), and a second position behind the wheelchair, a spring-mounted plunger pin 36 is secured, in vertical orientation, to post 24 as illustrated, with a handle 38 outwardly extending from plunger pin 36 for easy manipulation by a wheelchair user. The lower end of plunger pin 36 is attached to plate 39, to which plate is also secured an upstanding pin 40 with an appropriate spacer means 41 seated about the lower part of pin 40. The upstanding end of pin 40 is releasably positionable in aperture 42 of plate 44 secured to, and outwardly extending as illustrated (FIGS. 2 and 4) from a proximal portion of the side of container box 8. When the upper end of pin 40 is seated in aperture 42, box 8 is held, immobilized, in its first (operational) position beside the arm of the wheelchair. Pin 40, and its associated plunger pin 36 are biased, by means of spring 46 (FIG. 2) as illustrated. When handle 38 and plunger pin 36 are depressed against the bias of spring 46, plate 44 and pin 40 are appropriately lowered so that the upper end of pin 40 clears aperture 42, freeing container box 8 to swing on hinge pins 32 into second (storage) position behind the chair. Plate 44 is upwardly angled, away from aperture 42 as illustrated in FIG. 2, so that the top of pin 40 will slidably bear against the lower surface of that plate to urge it towards this second position once pin 40 has been freed from its engagement in aperture 42. When it is desired to move container box 8 from storage to operational position, box 8 merely has to be swung into operational position. Pin 41 will ride on the undersurface of plate 44 until it becomes aligned with, and as a result of the bias of the spring 46, engaged in, aperture 42.

Both notch 48 in plate 44, which seatably engages a portion of post 24 when container box 8 has been swung to its first position, and stopper 50 secured to box 8 to bear against a portion of post 24 when it is swung into this first position, act as stops to prevent movement of container box 8 beyond this first position.

The construction of the container may be of any appropriate material, for example, stucco-embossed aluminum material of approximately 18 gauge.

The backpack according to the present invention is released from its locked, second position, behind the back of the wheelchair, and easily swings on hinge pins 32 to a position which is adjacent to one or other of the armrests of the wheelchair. The invention may be mounted on most wheelchairs so that the container may be swung around adjacent to either the right or left armrest, whichever is most convenient for the user, depending upon on which side frame and back post assembly 4 it is mounted. When it is swung around adjacent to an armrest, in its second position, and locked therein by means of plunger pin 36 in aperture 40, its flat upper surface provides a convenient work surface on which to place items in use, such as a cup, glass, note pad. The backpack 2 provides easy accessibility to the interior chamber of container box 8, even for a person in a wheelchair having limited mobility. As previously indicated, container box 8 may be easily removed from its support assembly simply by lifting box 8 from its pivot assembly.

Thus, it is apparent that there has been provided in accordance with the present invention a mechanical backpack, that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A swing-out backpack for use on a wheel chair having an armrest provided along at least one side thereof and a side frame and back post assembly behind said armrest having upper handles extending rearwardly away from said armrest and spaced substantially vertically extending side posts connected to said upper handles at opposite sides of the back of said wheelchair comprising:

(a) a container box with sides, a back, a front, a top, and a bottom, having a pivotal door therein providing access to an interior chamber within the box;

(b) structure means releasably securing the container box to the side frame and back post assembly of the wheelchair, said structure means including:

(1) a post formed by a telescopic tube, (2) means to secure said post to said side frame and back post assembly in vertical orientation to the wheelchair at the armrest side thereof and spaced from one of said side posts, said means to secure said post including clamp means to clamp said post to one of the upper handles of the side frame and back post assembly and a lower clamp tube secured to a lower portion of the side frame and back post assembly and extending outwardly, rearwardly in horizontal orientation therefrom, said post extending between said clamp means and lower clamp tube, (3) and pivot means extending between said post and the container box, said container box being spaced from said post and pivotally mounted by said pivot means to swing between a first position adjacent and substantially parallel to an armrest of the wheelchair and a second position behind the side posts and the wheelchair and substantially normal to the armrest.

2. A backpack according to claim 1 further comprising lock means connected between the container box and operating to releasably secure the container box in the second position.

3. A backpack according to claim 2 wherein biasing means are associated with the container box and post to urge the container box to swing to the first position when the lock means is released.

4. A backpack according to claim 1 wherein the top of the container box is flat and positioned and oriented, when the box is in the first position, to provide a surface for writing or for supporting objects, for a wheelchair user.

5. A backpack according to claim 1 wherein the post of the structure means is provided with a pair of spaced, aligned pins extending in a direction parallel to the axis of the post and spaced from the post, and the container box is provided with a pair of outwardly extending ears having apertures to pivotally receive these pins when in position to permit the container box to pivot on the post.

6. A backpack according to claim 5 wherein a stop means is secured to the container box to bear against the post and prevent further pivoting of the box beyond said first position.

7. A backpack according to claim 2 wherein the lock means comprises a flange secured to and outwardly extending from the container box, the flange having apertures therein positioned to releasably receive a spring-mounted slidable pin secured to the post to lock the container box in either the first or second position, the slidable pin being positioned to be manipulable by a user of the wheelchair.

8. A backpack according to claim 1 wherein the top of the container is hinged to provide access to the interior chamber within the container box.

9. A swing out backpack for use on a wheelchair having a wheelchair frame with upper handle means extending rearwardly from a back section defined by said frame, said frame including spaced, substantially vertically extending side posts connected to said upper handle means at opposite sides of said back section, and at least one side arm extending forwardly of said back section at one side thereof and substantially normal thereto comprising:

a container having an internal chamber and means to provide access to said chamber, an elongated post, spaced mounting means connected to said post to removably mount said post on said wheelchair frame outwardly in spaced relationship to said back section and in a substantially vertical orientation relative to said wheelchair, said mounting means mounting said post in spaced, relationship adjacent to one end of said armrest, pivot means extending between said post and said container, said pivot means operating to space said container from said post to permit pivotal movement of said container from a first position adjacent and substantially parallel to said armrest to a second position behind and substantially parallel to said back section and substantially normal to said armrest, lock means mounted on said post and lock receiving means mounted upon said container, said lock means and lock receiving means operating to releasably lock said container in at least one of said first and second positions, said lock receiving means including a flange secured to and extending outwardly from the container, said flange having apertures therein positioned to releasably receive a pin, and said lock means including a spring biased slidable pin means secured to said post and operating to lock the container in either the first or second position, the pin means operating to engage the apertures in said flange and being positioned to be manipulated by a user of the wheelchair.

10. The backpack according to claim 9, wherein said pivot means includes a pair of spaced, aligned pins extending in a direction parallel to the axis of said post and mounted on said post in spaced relation thereto, and a pair of outwardly extending ears mounted on said container, each of said ears having an aperture to removably receive one of said pair of pins to permit the container to pivot about said pins.

11. The backpack according to claim 10, wherein a stop means is secured to said container to contact said post when the container reaches said first position to prevent further pivoting of the container beyond the first position.

12. The backpack according to claim 11, wherein the post is a telescopic tube, said mounting means connected to said post including an upper clamp means to engage the upper handle means and a lower clamp tube secured to a lower portion of said wheelchair frame and extending outwardly and rearwardly in horizontal orientation therefrom substantially normal to said post.

13. The backpack according to claim 12, wherein said container is of box-like configuration with interconnected spaced sides, a back, a front, a top, and a bottom, said top being flat and positioned, when said container is in the first position, to provide a substantially parallel surface above said armrest for use by a wheelchair user.

* * * * *